United States Patent [19]

van de Haar et al.

[11] Patent Number: 4,653,252

[45] Date of Patent: Mar. 31, 1987

[54] PACKING METHOD AND A BLANK FOR USE THEREIN

[75] Inventors: Rijk van de Haar, Joure; Johan H. C. Thomassen, Zeist, both of Netherlands

[73] Assignee: Douwe Egberts Koninklijke Tabaksfabriek Koffiebranderijen-Theehandel N.V., Netherlands

[21] Appl. No.: 693,736

[22] Filed: Jan. 22, 1985

[30] Foreign Application Priority Data

Jan. 19, 1984 [NL] Netherlands ..... 8400178

[51] Int. Cl.[4] ..... B65B 11/58

[52] U.S. Cl. ..... 53/449; 53/462; 493/98

[58] Field of Search ..... 53/170, 173, 207, 449, 53/462; 220/403, 410; 229/7; 493/98, 100, 99

[56] References Cited

U.S. PATENT DOCUMENTS

| | | | |
|---|---|---|---|
| 2,801,577 | 8/1957 | Ingham | 493/98 |
| 2,950,036 | 8/1960 | Vergobbi | 493/99 |
| 3,173,576 | 3/1965 | Curie et al. | 229/7.9 |
| 3,832,822 | 9/1974 | Sherman | 53/207 |
| 4,548,025 | 10/1985 | Heisler | 53/207 |

FOREIGN PATENT DOCUMENTS

| | | | |
|---|---|---|---|
| 6029220 | 5/1981 | European Pat. Off. | 493/98 |

*Primary Examiner*—John Sipos
*Assistant Examiner*—Donald R. Studebaker
*Attorney, Agent, or Firm*—Scully, Scott Murphy & Presser

[57] ABSTRACT

A method of manufacturing a combination of a case accommodating a flexible synthetic plastics container or bag having a pouring opening and filled at least partly with liquid. The starting point for forming the case is a blank having such folding lines and cuts that when the blank is folded about the synthetic plastics bag, the latter is automatically fixed in the case being formed. The blank has two rectangular portions, one so-called base portion and a top face portion, which portions are interconnected by a second end face panel. The two edges of the base portion opposite the second end face panel and the top face portion connect with a first end face panel and a third end face panel, respectively. The opposed free edges of the base portion and the top face portion connect with side panels, and at least a part of the end face panels is provided with flaps. The various portions are interconnected by means of folding lines. The first end face panel is free from flaps and the edges of the side panels of the base portion directed thereto are provided with flaps.

11 Claims, 5 Drawing Figures

PACKING METHOD AND A BLANK FOR USE THEREIN

BACKGROUND OF THE INVENTION

The present invention relates to a method of manufacturing a combination of a case accommodating a flexible synthetic plastics container or bag provided with a pouring opening and filled at least partly with liquid.

It is generally known first to manufacture a cardboard case and subsequently insert a synthetic plastics container therein. In many cases, the packing of containers in such a manner is highly satisfactory, but it is less suitable when the synthetic plastics container includes a spout or the like which has to be arranged exactly in its proper place opposite a portion of the case bounded by a score line. The latter is in particular true in the case of containers filled with liquids, such as coffee extracts, fruit drinks, syrups or like beverages, which containers are placed bodily, i.e. together with the case upside down, i.e. with the spout on the underside, in a vending machine.

For the sake of completeness, it is observed that this reproducibility is highly important, in particular when the unit has to be frozen. In that case, it is ensured that freezing will always take place in the same manner, viz. the progress of the solidification front is always the same. As a result, the liquid is prevented from being present e.g. on one side of the container or bag, so that, on solidification, which usually is attended with expansion, the bag will be torn. A further result is that emptying also takes place in a controlled manner resulting in minimum residual quantities.

SUMMARY OF THE INVENTION

It is an object of the present invention to provide a method of the above described type which eliminates the above drawbacks.

To this end, a method of the above described type is characterized in that, the case is formed starting from a blank having such folding lines and cuts that when the blank is folded about the synthetic plastics bag, the latter is automatically fixed in the case being formed.

For that purpose, use can be made of a blank having a rectangular base portion with a width smaller than that of the at least partly filled synthetic plastics bag; at least three sides of the said base portion being each connected through a folding line with a side panel, with the two opposite side panels being provided at least at the edge facing the third panel or end face portion with a flap connected therewith by means of a folding line. After placing the at least partly filled container on the blank in such manner that it extends over the folding line between the base portion and the end face panel, first the latter panel is folded and subsequently the two opposite side panels and finally, with the corners of the container being taken up, the two flaps are folded back against said end face panel.

Use can also be made of a blank whose side opposite the said first end face panel is fitted with a second end face panel connected thereto by means of a folding line, the two opposite "free" edges of said second panel being provided with flaps connected thereto through a folding line. In this manner, it is possible to produce a case that is open at one end only and wherein the flexible synthetic plastics container is fixed at least partly.

In a further embodiment of the present invention, the free edge of the second end face panel can link up via a folding line with a portion consisting of a top face portion linking up with two side panels, and a third end face panel, respectively, similarly as is the case with the base portion, and in which after folding the first end face portion linking up with the base portion and the two side panels, first the second end face portion is folded, at least partly, and then the top face portion, the last two portions being fitted with a portion bounded by a tear line to form a passage. In this way it is possible to pack a flexible synthetic plastics container having a projecting spout in a reproducible and fixed manner in a case that is closed on all sides.

Use can be made for this purpose of a blank whose third end face portion linking up with the top face portion includes flaps at the two opposite side edges, and in which, after folding the top face portion, the flaps connected to the second end face panel are folded. Subsequently, the third end face panel, then the flaps connected thereto and finally the two side panels connected to the top face portion are folded.

To ensure that after the case has been folded in this manner, this remains in the folded position, at least the folded flaps of the third end face panel can be glued onto the subjacent portion. Also, the folded side panels connected to the top face portion can be glued onto the subjacent portion.

In order to obtain a controlled longitudinally seam or transverse seam during the manufacture of the combination of the cardboard case and the flexible synthetic plastics container, it is possible, after placing the at least partly filled container on the blank, that this is retained thereon provisionally by means of a frame consisting of three rods corresponding in shape and size with the folding lines connecting the two side panels and the first end face panel to the base portion.

The present invention also relates to a blank having two rectangular portions, one so-called base portion and one top face portion, which portions are interconnected by a second end face panel, while the two edges of the base portion opposite the second end face panel and the top face portion are provided with a first end face panel and a third end face panel, respectively; the opposite free edges of the base portion and the top face portion are fitted with side panels and at least a part of the end face panels are fitted with flaps, the various portions being interconnected by means of folding lines. Such a blank is well known for making a box-shaped case, more in particular destined for packing pastry. Such a blank is characterized according to the invention in that the first end face panel is free from flaps and the edges of the side panels of the base portion directed thereto have flaps. This makes it possible during the assembly of the case and the filled synthetic plastics container to fix the latter within the case.

In a further embodiment of the invention the blank may have a number of peep-holes so that, in use, the filling position of the flexible synthetic plastics bag accommodated in the case can be inspected. Said peep-holes have the additional purpose of promoting freezing.

The blank according to the invention has the further great advantage that, after folding, two-ply or three-ply layers are provided in various places of the case, thus providing for great strength and on the other hand enabling the designer to choose lighter starting material.

BRIEF DESCRIPTION OF THE DRAWINGS

One embodiment of the manufacture of the assembly of a case containing a flexible synthetic plastics container having a spout and filled at least partly with liquid will now be described, by way of example, with reference to the accompanying drawings, in which.

DETAILED DESCRIPTION OF THE PREFERRED EMBODIMENTS

Figure 1:
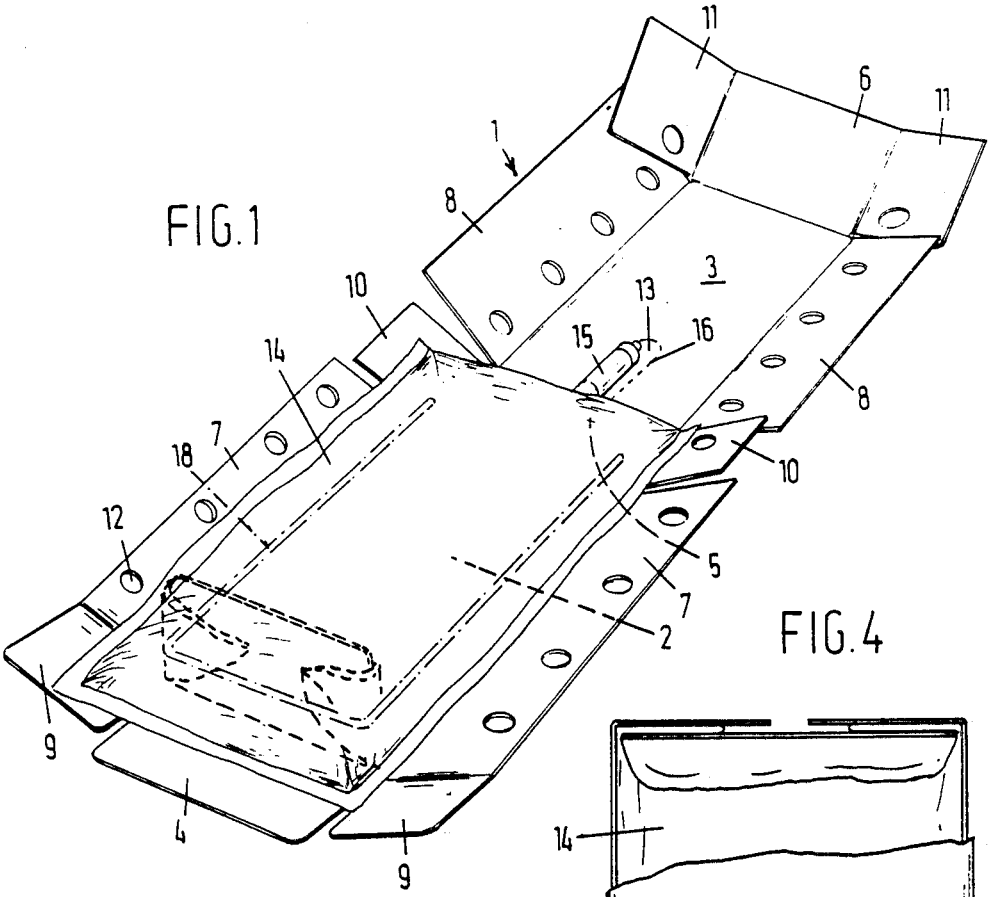
FIG. 1 is a perspective view of a blank of a case on which is placed a flexible synthetic plastics container having a spout and filled partly with liquid.
Figure 4:
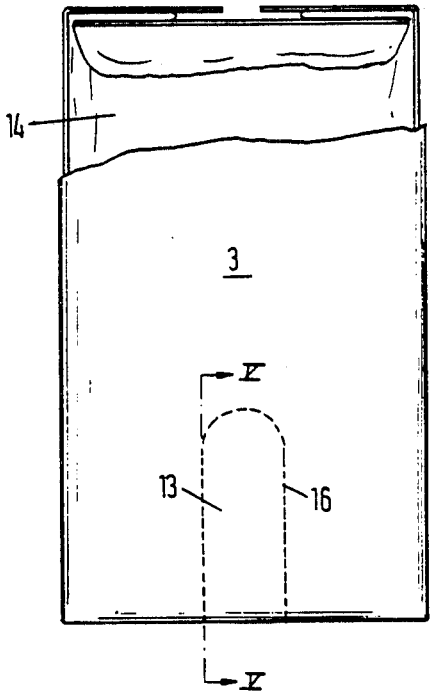
FIG. 4 is a part-cross-sectional top view of the manufactured combination of case and synthetic plastics container.
Figure 5:
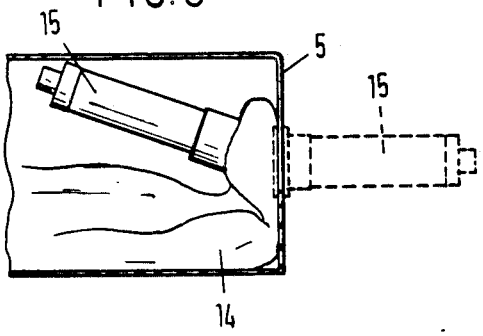
FIG. 5 is a cross-sectional view taken on the line V—V of FIG. 4.

As shown in the drawings, a blank 1 for making an assembly of a cardboard case containing a flexible synthetic plastics container or bag 14 having a spout 15 and filled at least partly with liquid comprises successively the following parts:

- a base portion 2;
- a top face portion 3;
- a first end face panel 4 connected to the base portion;
- a second end face panel 5 interconnecting the said base portion and top face portion;
- a third end face panel 6;
- side panels 7 connected to the base portion 2;
- side panels 8 connected to the top face portion 3;
- flaps 9 connected to the edges of the side panels 7 directed to the first end face portion 4;
- flaps 10 connected to the second end face portion 5; and
- flaps 11 connected to the opposite "free" edges of the third end face panel 6.

The above parts are interconnected by means of folding lines, not shown.

As also shown in the drawings, the blank, adjacent the top face portion and the second end face portion, is provided with a portion 13 bounded by a tear-off line 16 to form a passage for the spout 15.

Besides, side panels 7, flaps 10, side panels 8 and flaps 11 contain peep-holes 12.

Figure 2:
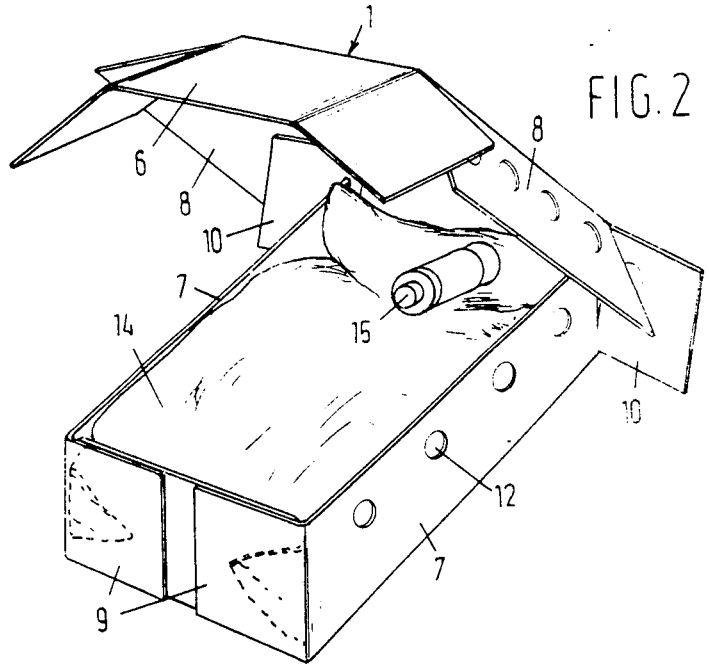
FIG. 2 is a view similar to FIG. 1, but with the parts in different relative positions.
Figure 3:
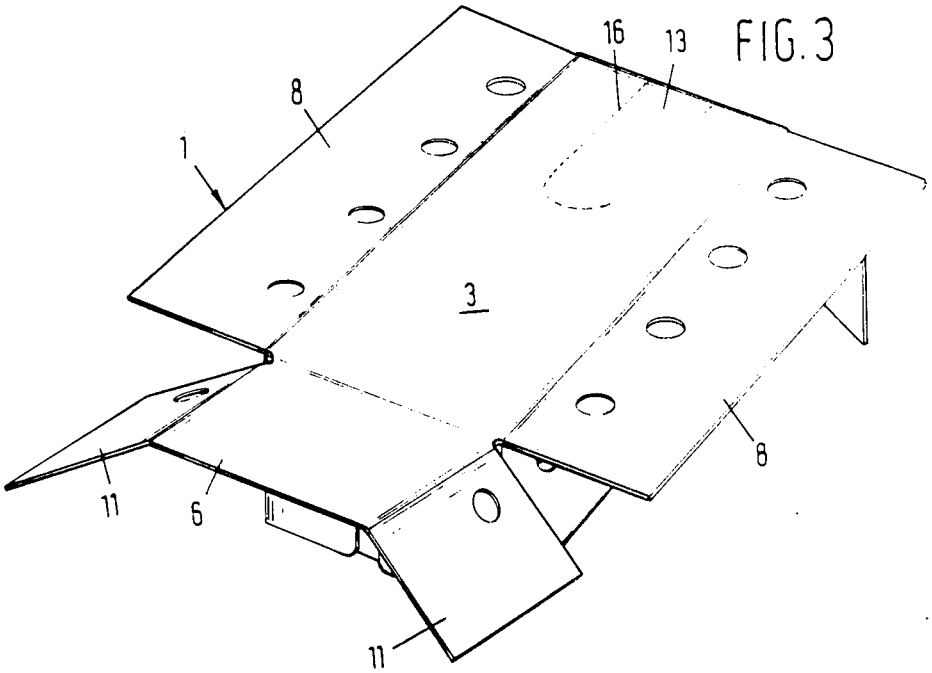
FIG. 3 is a view similar to FIG. 1, but with the parts again in different relative positions.

As shown more in particular in FIGS. 1 and 2, the flexible synthetic plastics bag 14 has a width larger than that of the base portion 1. When the synthetic plastics bag is placed on the blank 1, it is arranged in such a manner that the transverse edge opposite the spout 15 extends at least partly over the first end face panel 4.

After properly positioning the synthetic plastics container or bag 14 on the blank 1, a frame 18 shown in dotted lines is lowered thereon, thus further increasing the reproducibility of the desired arrangement of the container in the case. After this, folding can be initiated and the first end face panel 4 is brought into the desired position (shown in dashed lines in FIG. 1). As a result, two corners 17 are formed on the synthetic plastics bag, which corners are accentuated when the side panels 7 are brought to the desired position. The two flaps 9 connected to the first side panels 7 are then folded back against the folded first end face panel whereby corners 17 are fixed relative to the case.

After the retraction of the frame 18, the second end face portion 5 and simultaneously or subsequently the base portion 3 are folded. Then flaps 10, the third end face portion 6, flaps 11 and finally side panels 8 are successively folded. In order to ensure fixation of the case made, the side panels 8 connected to the top face portion 3, which are folded last, are provided before the folding with an adhesive layer, not shown, for securing the same onto the subjacent portion, i.e. side panels 7, and side flaps 10, 11, respectively. Another possibility is to provide flaps 11 of the third end face panel 6 before the folding with an adhesive layer, not shown, for its attachment to the subjacent portion, i.e. side panels 7.

It will be clear that the above mentioned peep-holes 12 are disposed in the various portions in such a manner that after completion the assembly of the case containing the filled synthetic plastics container or bag, the degree of filling of the said container may be inspected.

It will be clear that a great many modifications are possible without departing from the scope of the present invention. For instance, use can also be made of a blank of which only portions 2, 4, 5, 7 and 9 are provided in accordance with the embodiment shown, and wherein the flaps 10 are attached to the side panels 7 instead of to the second end face panel 5, while the top face portion and the panels attached thereto are lacking. Various variants are conceivable in this manner.

What I claim is:

1. A method of manufacturing a carton holding a flexible, shapeless container having an outlet, comprising the steps of:

filling said container at least partially with a liquid;

providing a blank including a base, and a plurality of panels connected to the base, said base having a rectangular shape with a width less than the width of the container and lateral sides and transverse sides, said plurality of panels including at least one end panel connected to said transverse side and side panels having flaps thereon connected to said lateral sides;

placing the container on the blank; and folding the blank about the container to form the carton with the container held therein;

the folding step including the steps of folding said end panel inward toward the vase to form corners in the container, folding said side panels inward toward the base and folding the flaps inward toward said end panel to clamp said corners of the container between said end panel and the flaps to thereby secure the container to the carton, the container being connected to the carton solely by clamping the container between overlapping panels of the carton.

2. A method according to claim 1, wherein:

the plurality of panels further includes (i) a first end panel connected by a first fold line to the first transverse side of the base, (ii) first and second side panels respectively connected by second and third fold lines to the first and second lateral sides of the base, each of the first and second side panels having an edge adjacent the first end panel, and (iii) first and second flaps respectively connected by fold lines to the edges of the first and second side panels;

the placing step includes the step of placing the container on the blank, with the container extending over the fold line connecting the base and the first end panel;

the step of folding the blank further includes the steps of (i) folding the first end panel inward toward the base to form first and second corners in the container respectively projecting outward of the first and second lateral sides of the base, and (ii) folding the first and second side panels inward toward the base to force the first and second corners of the container to positions projecting outward of the first end panel; and the overlapping step includes the step of folding the first and second flaps inward toward the first end panel to clamp the first and second corners of the container between the first end panel and the first and second flaps respectively, to thereby secure the container to the blank.

3. A method according to claim 2, wherein the plurality of panels further includes:

a second end panel connected by a fold line to the second transverse side of the base, the second end panel having first and second opposite edges; and third and fourth flaps respectively connected by fold lines to the first and second edges of the second end panel.

4. A method according to claim 3, wherein:

the blank further includes a top portion connected by a fold line to the second end panel, the top portion having first and second lateral sides and a first transverse side, the second end panel and the top portion including a tear line to facilitate tearing an opening in the carton for the outlet of the container;

the plurality of panels further includes (i) third and fourth side panels respectively connected by fold lines to the first and second lateral sides of the top portion, (ii) a third end panel connected by a fold line to the first transverse side of the top portion; and the step of folding the blank further includes the steps of (i) folding the second end panel at least partially toward the base, and (ii) folding the top portion toward the base.

5. A method according to claim 4, wherein:

the third end panel includes first and second opposite edges;

the plurality of panels further includes fifth and sixth flaps respectively connected by fold lines to the first and second edges of the third end panel;

the step of folding the top portion includes the step of folding the top portion over the container; and the step of folding the blank further includes the step of folding the third and fourth flaps inward respectively against the first and second side panels after the top portion has been folded over the container.

6. A method according to claim 5, wherein the step of folding the blank further includes the step of:

after folding the third and fourth flaps against the first and second side panels, folding the third end panel against the first and second flaps, then folding the fifth and sixth flaps respectively against the first and second side panels, and then folding the third side panel against the third and fifth flaps and folding the fourth side panel against the fourth and sixth flaps.

7. A method according to claim 6, further including the steps of:

gluing the fifth flap to the first side panel; and gluing the sixth flap to the second side panel.

8. A method according to claim 7, further including the step of gluing the third and fourth side panels in place after they have been folded.

9. A method according to claim 1, further including the step of placing a frame on the container to hold the container provisionally in place on the blank.

10. A method according to claim 9, wherein the frame includes first, second and third legs, and the step of placing the frame on the container includes the steps of:

placing the first leg over the first fold line;

placing the second leg over the second fold line; and placing the third leg over the tird fold line;

11. A method according to claim 10, wherein:

the first leg has a length substantially equal to the length of the first fold line;

the second leg has a length substantially equal to the length of the second fold line;

the third leg has a length substantially equal to the length of the third fold line;

the step of placing the first leg includes the step of placing the first leg over the entire length of the first fold line;

the step of placing the second leg includes the step of placing the second leg over the entire length of the second fold line; and the step of placing the third leg includes the step of placing the third leg over the entire length of the third fold line.

* * * * *